US007343281B2

(12) United States Patent
Breebaart et al.

(10) Patent No.: US 7,343,281 B2
(45) Date of Patent: Mar. 11, 2008

(54) PROCESSING OF MULTI-CHANNEL SIGNALS

(75) Inventors: Dirk Jeroen Breebaart, Eindhoven (NL); Erik Gosuinus Petrus Schuijers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 28 days.

(21) Appl. No.: 10/549,370

(22) PCT Filed: Mar. 15, 2004

(86) PCT No.: PCT/IB2004/050255

§ 371 (c)(1),
(2), (4) Date: Sep. 14, 2005

(87) PCT Pub. No.: WO2004/084185

PCT Pub. Date: Sep. 30, 2004

(65) Prior Publication Data

US 2006/0178870 A1 Aug. 10, 2006

(30) Foreign Application Priority Data

Mar. 17, 2003 (EP) ..... 03100664

(51) Int. Cl.
*G10L 21/00* (2006.01)

(52) U.S. Cl. ..... 704/205

(58) Field of Classification Search ..... 704/205
See application file for complete search history.

(56) References Cited

U.S. PATENT DOCUMENTS 5,129,006 A 7/1992 Hill et al.

(Continued)

FOREIGN PATENT DOCUMENTS

EP 0466665 1/1992

(Continued)

OTHER PUBLICATIONS

Christof Faller, et al: Efficient Representation of Spatial Audio Using Perceptual Parametrization, WASPAA, Oct. 2001, New Paltz.

(Continued)

*Primary Examiner*—Richemond Dorvil
*Assistant Examiner*—Jakieda Jackson

(57) ABSTRACT

A method of generating a monaural signal (S) includes a combination of at least two input audio channels (L, R). Corresponding frequency components from respective frequency spectrum representations for each audio channel (L(k), R(k)) are summed to provide a set of summed frequency components (S(k)) for each sequential segment. For each frequency band (i) of each of sequential segment, a correction factor (m(i)) is calculated as function of a sum of energy of the frequency components of the summed signal in the band $$\left(\sum_{k\in i}|S(k)|^2\right)$$

and a sum of the energy of the frequency components of the input audio channels in the band $$\left(\sum_{k\in i}\{|L(k)|^2+|R(k)|^2\}\right).$$

Each summed frequency component is corrected as a function of the correction factor (m(i)) for the frequency band of the component.

14 Claims, 3 Drawing Sheets

U.S. PATENT DOCUMENTS

| | | | | |
|---|---|---|---|---|
| 5,388,181 | A | 2/1995 | Anderson et al. | |
| 5,701,346 | A | 12/1997 | Herre et al. | |
| 5,740,523 | A * | 4/1998 | Nakajima et al. | 455/186.1 |
| 5,850,453 | A | 12/1998 | Klayman et al. | |
| 5,982,901 | A * | 11/1999 | Kane et al. | 381/13 |
| 7,110,554 | B2 * | 9/2006 | Brennan et al. | 381/94.7 |
| 2002/0154041 | A1 * | 10/2002 | Suzuki et al. | 341/51 |

FOREIGN PATENT DOCUMENTS

| | | | |
|---|---|---|---|
| EP | 0481821 | A2 | 4/1992 |
| EP | 0887958 | A1 | 12/1998 |
| EP | 0887958 | B1 | 12/1998 |
| EP | 1107232 | | 6/2001 |
| WO | 03085643 | | 10/2003 |
| WO | 03085645 | | 10/2003 |
| WO | 03090208 | | 10/2003 |

OTHER PUBLICATIONS

Von Bernd Edler: Codierung von Audiosignalen Mit Uberlappender Transformation and Adaptiven Fensterfunktionen, 1989, pp. 252-256, XP111152987.

Efficient representation of spatial audio using perceptual parametrization by C. Faller and F. Baumgarte, WASPAA '01, Workshop, New Paltz, New York, 2001.

European Patent Application 02079817.9, Nov. 19, 2002.

European Patent Application 02076408.0, Sep. 4, 2002.

European Patent Application 02076410.6, Sep. 4, 2002.

* cited by examiner

PROCESSING OF MULTI-CHANNEL SIGNALS

BACKGROUND OF THE INVENTION

1. Field of the Invention

The present invention relates to the processing of audio signals and, more particularly, the coding of multi-channel audio signals.

2. Description of the Related Art

Parametric multi-channel audio coders generally transmit only one full-bandwidth audio channel combined with a set of parameters that describe the spatial properties of an input signal. For example, FIG. 1 shows the steps performed in an encoder 10 described in International Application No. WO2003/90208, filed Apr. 22, 2003.

In an initial step S1, input signals L and R are split into subbands 101, for example, by time-windowing followed by a transform operation. Subsequently, in step S2, the level difference (ILD) of corresponding subband signals is determined; in step S3, the time difference (ITD or IPD) of corresponding subband signals is determined; and in step S4, the amount of similarity or dissimilarity of the waveforms which cannot be accounted for by ILDs or ITDs, is described. In the subsequent steps S5, S6, and S7, the determined parameters are quantized.

In step S8, a monaural signal S is generated from the incoming audio signals, and finally, in step S9, a coded signal 102 is generated from the monaural signal and the determined spatial parameters.

FIG. 2 shows a schematic block diagram of a coding system comprising the encoder 10 and a corresponding decoder 202. The coded signal 102, comprising the sum signal S and spatial parameters P, is communicated to a decoder 202. The signal 102 may be communicated via any suitable communications channel 204. Alternatively, or additionally, the signal may be stored on a removable storage medium 214, which may be transferred from the encoder to the decoder.

Synthesis (in the decoder 202) is performed by applying the spatial parameters to the sum signal to generate left and right output signals. Hence, the decoder 202 comprises a decoding module 210 which performs the inverse operation of step S9 and extracts the sum signal S and the parameters P from the coded signal 102. The decoder further comprises a synthesis module 211 which recovers the stereo components L and R from the sum (or dominant) signal and the spatial parameters.

One of the challenges is to generate the monaural signal S, step S8, in such a way that, on decoding into the output channels, the perceived sound timbre is exactly the same as for the input channels.

Several methods of generating this sum signal have been suggested previously. In general, these methods compose a mono signal as a linear combination of the input signals. Particular techniques include:

1. Simple summation of the input signals. See, for example, 'Efficient representation of spatial audio using perceptual parametrization', by C. Faller and F. Baumgarte, WASPAA'01, Workshop on applications of signal processing on audio and acoustics, New Paltz, New York, 2001.

2. Weighted summation of the input signals using principle component analysis (PCA). See, for example, International Patent Application No. WO2003/85645, filed Mar. 20, 2003 and International Patent Application No. WO2003/85643 filed Mar. 20, 2003. In this scheme, the squared weights of the summation sum up to one and the actual values depend on the relative energies in the input signals.

3. Weighted summation with weights depending on the time-domain correlation between the input signals. See for example 'Joint stereo coding of audio signals', by D. Sinha, European Patent Application No. EP 1 107 232 A2. In this method, the weights sum to +1, while the actual values depend on the cross-correlation of the input channels.

4. U.S. Pat. No. 5,701,346 to Herre et al. discloses weighted summation with energy-preservation scaling for downmixing left, right, and center channels of wideband signals. However, this is not performed as a function of frequency.

These methods can be applied to the full-bandwidth signal or can be applied on band-filtered signals which all have their own weights for each frequency band. However, all of the methods described have one drawback. If the cross-correlation is frequency-dependent, which is very often the case for stereo recordings, coloration (i.e., a change of the perceived timbre) of the sound of the decoder occurs.

This can be explained as follows: For a frequency band that has a cross-correlation of +1, linear summation of two input signals results in a linear addition of the signal amplitudes and squaring the additive signal to determine the resultant energy. (For two in-phase signals of equal amplitude, this results in a doubling of amplitude with a quadrupling of energy.) If the cross-correlation is 0, linear summation results in less than a doubling of the amplitude and a quadrupling of the energy. Furthermore, if the cross-correlation for a certain frequency band amounts −1, the signal components of that frequency band cancel out and no signal remains. Hence, for simple summation, the frequency bands of the sum signal can have an energy (power) between 0 and four times the power of the two input signals, depending on the relative levels and the cross-correlation of the input signals.

SUMMARY OF THE INVENTION

The present invention attempts to mitigate this problem and provides a method of generating a monaural signal (S) comprising a combination of at least two input audio channels (L, R), comprising the steps of:

for each of a plurality of sequential segments (t(n)) of said audio channels (L, R), summing (46) corresponding frequency components from respective frequency spectrum representations for each audio channel (L(k), R(k)) to provide a set of summed frequency components (S(k)) for each sequential segment;

for each of said plurality of sequential segments, calculating (45) a correction factor (m(i)) for each of a plurality of frequency bands (i) as function of the energy of the frequency components of the summed signal in said band $$\left(\sum_{k\in i}|S(k)|^2\right)$$

and the energy of said frequency components of the input audio channels in said band $$\left(\sum_{k\in i}\{|L(k)|^2+|R(k)|^2\}\right);$$

and correcting (47) each summed frequency component as a function of the correction factor (m(i)) for the frequency band of said component.

If different frequency bands tended to, on average, have the same correlation, then one might expect that over time, distortion caused by such summation would average out over the frequency spectrum. However, it has been recognized that, in multi-channel signals, low frequency components tend to be more correlated than high frequency components. Therefore, it will be seen that without the present invention, summation, which does not take into account frequency dependent correlation of channels, would tend to unduly boost the energy levels of more highly correlated and, in particular, psycho-acoustically sensitive low frequency bands.

The present invention provides a frequency-dependent correction of the mono signal where the correction factor depends on a frequency-dependent cross-correlation and relative levels of the input signals. This method reduces spectral coloration artefacts which are introduced by known summation methods and ensures energy preservation in each frequency band.

The frequency-dependent correction can be applied by first summing the input signals (either summed linear or weighted) followed by applying a correction filter, or by releasing the constraint that the weights for summation (or their squared values) necessarily sum up to +1 but sum to a value that depends on the cross-correlation.

It should be noted that the invention can be applied to any system where two or more two input channels are combined.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
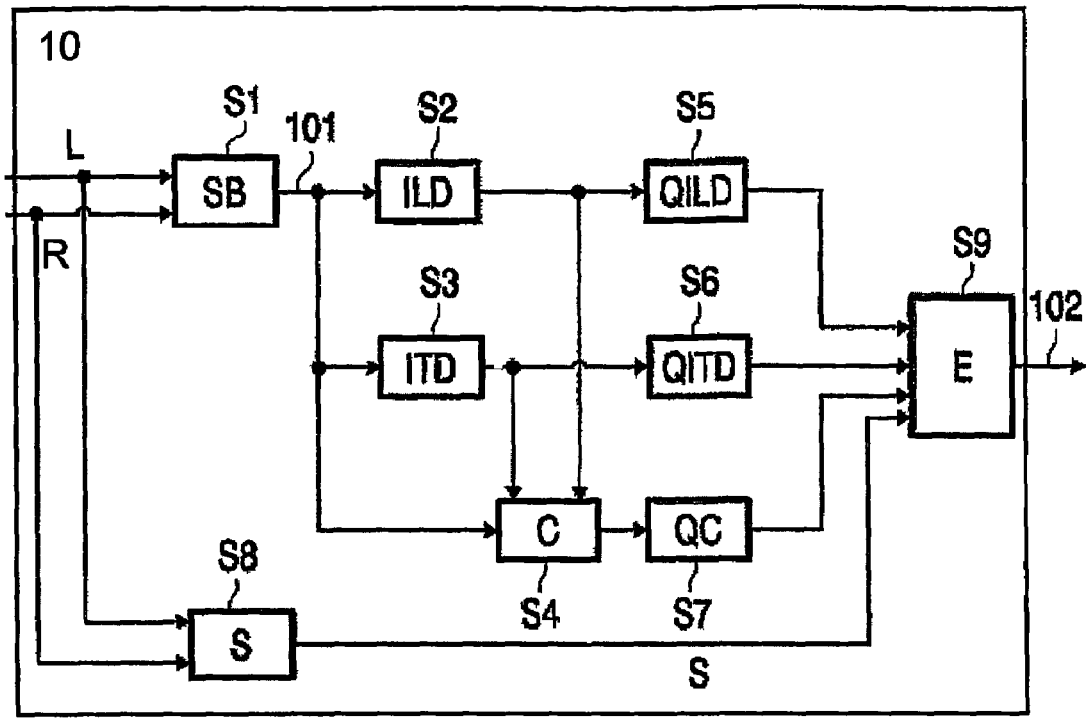
FIG. 1 shows a prior art encoder.
Figure 2:
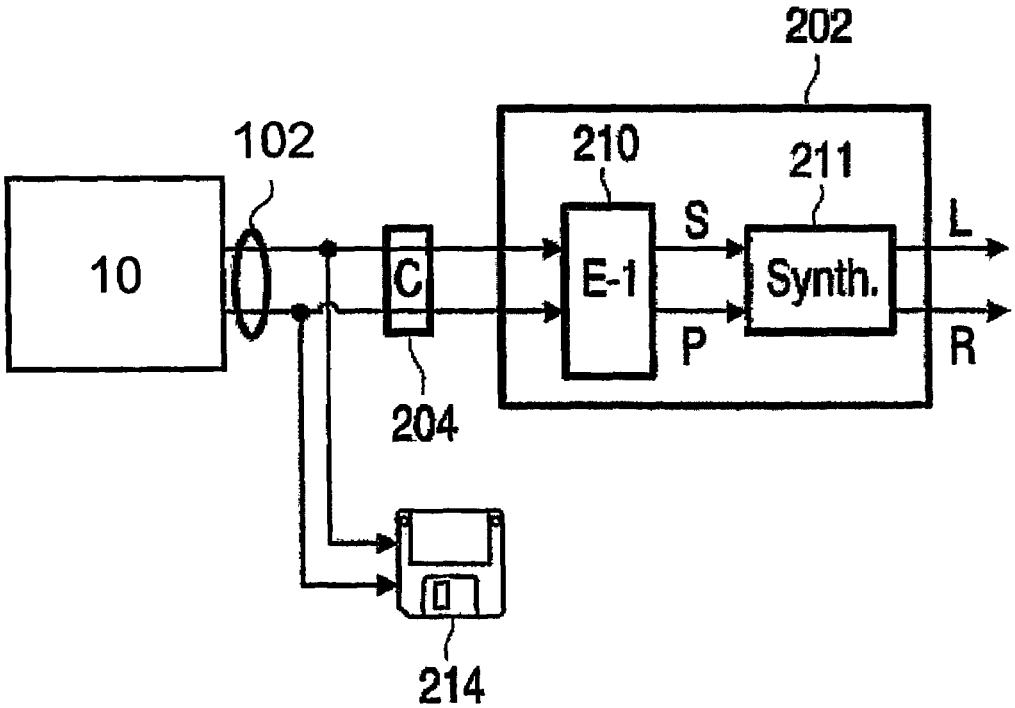
FIG. 2 shows a block diagram of an audio system including the encoder of FIG. 1.

According to the present invention, there is provided an improved signal summation component (S8'), in particular, for performing the step corresponding to S8 of FIG. 1. Nonetheless, it will be seen that the invention is applicable anywhere two or more signals need to be summed. In a first embodiment of the invention, the summation component adds left and right stereo channel signals prior to the summed signal S being encoded, step S9.

Figure 3:
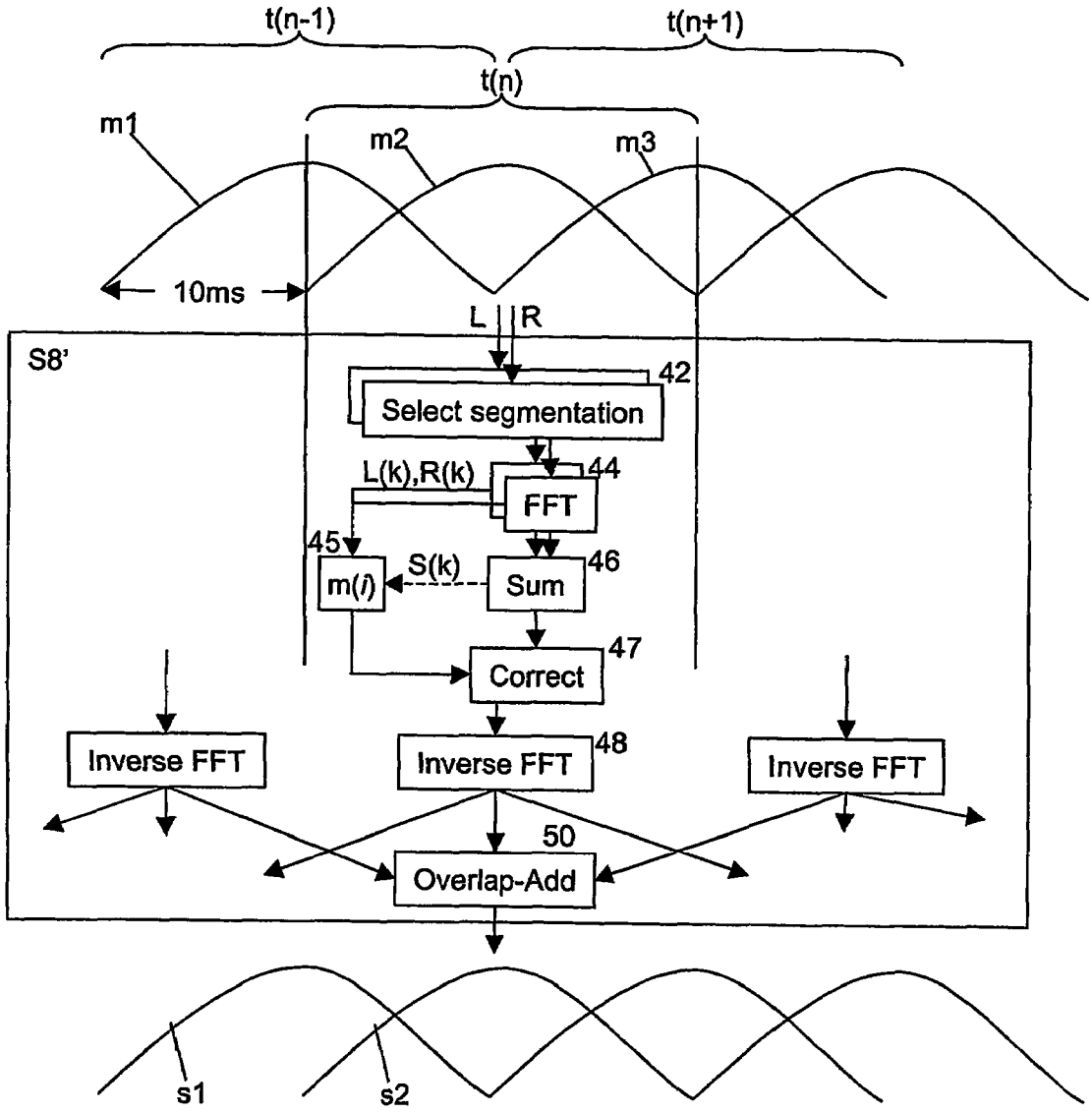
FIG. 3 shows the steps performed by a signal summation component of an audio coder according to a first embodiment of the invention.

Referring now to FIG. 3, in the first embodiment, the left (L) and right (R) channel signals provided to the summation component comprise multi-channel segments m1, m2 . . . overlapping in successive time frames t(n−1), t(n), t(n+1). Typically sinusoids, are updated at a rate of 10 ms and each segment m1, m2 . . . is twice the length of the update rate, i.e., 20 ms.

For each overlapping time window t(n−1),t(n),t(n+1) for which the L,R channel signals are to be summed, the summation component uses a (square-root) Hanning window function to combine each channel signal from overlapping segments m1, m2 . . . into a respective time-domain signal representing each channel for a time window, step 42.

An FFT (Fast Fourier Transform) is applied on each time-domain windowed signal, resulting in a respective complex frequency spectrum representation of the windowed signal for each channel, step 44. For a sampling rate of 44.1 kHz and a frame length of 20 ms, the length of the FFT is typically 882. This process results in a set of K frequency components for both input channels (L(k), R(k)).

In the first embodiment, the two input channels representations L(k) and R(k) are first combined by a simple linear summation, step 46. It will be seen, however, that this could easily be extended to a weighted summation. Thus, for the present embodiment, sum signal S(k) comprises:

$$S(k)=L(k)+R(k)$$

Separately, the frequency components of the input signals L(k) and R(k) are grouped into several frequency bands, preferably using perceptually-related bandwidths (ERB or BARK scale) and, for each subband i, an energy-preserving correction factor m(i) is computed, step 45:

$$m^2(i)=\frac{\sum_{k\in i}\{|L(k)|^2+|R(k)|^2\}}{2\sum_{k\in i}|S(k)|^2}=\frac{\sum_{k\in i}\{|L(k)|^2+|R(k)|^2\}}{2\sum_{k\in i}|L(k)+R(k)|^2} \quad \text{Equation 1}$$

which can also be written as:

$$m^2(i)=\frac{1}{2}\frac{\sum_{k\in i}\{|L(k)|^2+|R(k)|^2\}}{\sum_{k\in i}|L(k)|^2+\sum_{k\in i}|R(k)|^2+2\rho_{LR}(i)\sqrt{\sum_{k\in i}|L(k)|^2\sum_{k\in i}|R(k)|^2}} \quad \text{Equation 2}$$

with $\rho_{LR}(i)$ being the (normalized) cross-correlation of the waveforms of subband i, a parameter used elsewhere in parametric multi-channel coders and so readily available for the calculations of Equation 2. In any case, step 45 provides a correction factor m(i) for each subband i.

The next step 47 then comprises multiplying the each frequency component S(k) of the sum signal with a correction filter C(k):

$$S'(k)=S(k)C(k)=C(k)L(k)+C(k)R(k) \quad \text{Equation 3}$$

It will be seen from the last component of Equation 3 that the correction filter can be applied to either the summed signal (S(k) alone or each input channel (L(k),R(k)). As such, steps 46 and 47 can be combined when the correction factor m(i) is known or performed separately with the summed signal S(k) being used in the determination of m(i), as indicated by the hashed line in FIG. 3.

Figure 4:
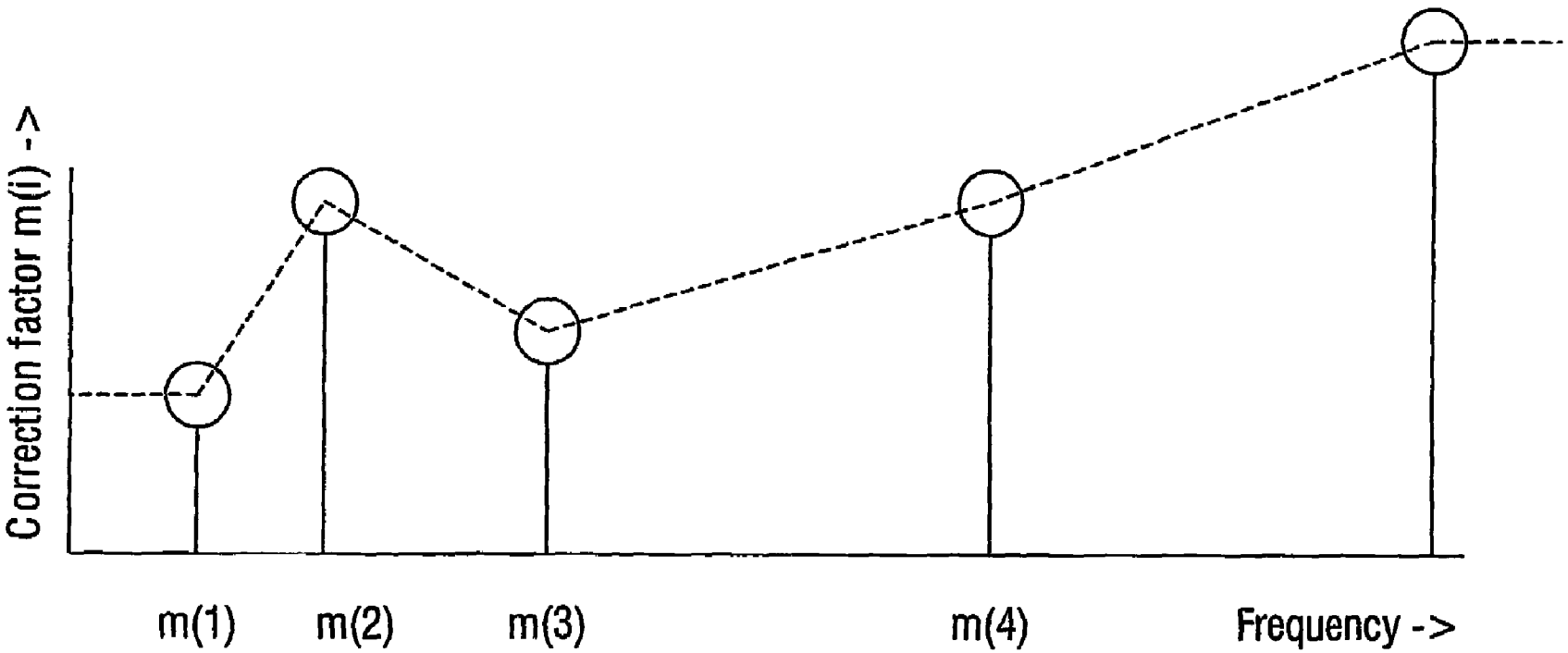
FIG. 4 shows linear interpolation of the correction factors m(i) applied by the summation component of FIG. 3.

In the preferred embodiments, the correction factors m(i) are used for the center frequencies of each subband, while for other frequencies, the correction factors m(i) are interpolated to provide the correction filter C(k) for each frequency component (k) of a subband i. In principle, any interpolation function can be used, however, empirical results have shown that a simple linear interpolation scheme suffices, FIG. 4.

Alternatively, an individual correction factor could be derived for each FFT bin (i.e., subband i corresponds to frequency component k), in which case no interpolation is necessary. This method, however, may result in a jagged rather than a smooth frequency behavior of the correction factors which is often undesired due to resulting time-domain distortions.

In the preferred embodiments, the summation component then takes an inverse FFT of the corrected summed signal S'(k) to obtain a time domain signal, step 48. By applying overlap-add for successive corrected summed time domain signals, step 50, the final summed signal s1, s2 . . . is created and this is fed through to be encoded, step S9, FIG. 1. It will be seen that the summed segments s1, s2 . . . correspond to the segments m1, m2 . . . in the time domain and as such, no loss of synchronization occurs as a result of the summation.

It will be seen that where the input channel signals are not overlapping signals but rather continuous time signals, then the windowing step 42 will not be required. Similarly, if the encoding step S9 expects a continuous time signal rather than an overlapping signal, the overlap-add step 50 will not be required. Furthermore, it will be seen that the described method of segmentation and frequency-domain transformation can also be replaced by other (possibly continuous-time) filterbank-like structures. Here, the input audio signals are fed to a respective set of filters, which collectively provide an instantaneous frequency spectrum representation for each input audio signal. This means that sequential segments can, in fact, correspond with single time samples rather than blocks of samples as in the described embodiments.

It will be seen from Equation 1 that there are circumstances where particular frequency components for the left and right channels may cancel out one another or, if they have a negative correlation, they may tend to produce very large correction factor values $m^2(i)$ for a particular band. In such cases, a sign bit could be transmitted to indicate that the sum signal for the component S(k) is:

$$S(k)=L(k)-R(k)$$

with a corresponding subtraction used in equations 1 or 2.

Alternatively, the components for a frequency band i might be rotated more into phase with one another by an angle α (i). The ITD analysis process S3 provides the (average) phase difference between (subbands of the) input signals L(k) and R(k). Assuming that for a certain frequency band i, the phase difference between the input signals is given by α(i), the input signals L(k) and R(k) can be transformed to two new input signals L'(k) and R'(k) prior to summation according to the following:

$$L'(k)=e^{jc\alpha(i)}L(k)$$

$$R'(k)=e^{-j(1-c)\alpha(i)}R(k)$$

with c being a parameter which determines the distribution of phase alignment between the two input channels (0·c·1).

In any case, it will be seen that where, for example, two channels have a correlation of +1 for a sub-band i, then $m^2(i)$ will be ¼ and so m(i) will be ½. Thus, the correction factor C(k) for any component in the band i will tend to preserve the original energy level by tending to take half of each original input signal for the summed signal. However, as can be seen from Equation 1, where a frequency band i of a stereo signal includes spatial properties, the energy of the signal S(k) will tend to get smaller than if they were in phase, while the sum of the energies of the L, R signals will tend to stay large and so the correction factor will tend to be larger for those signals. As such, overall energy levels in the sum signal will still be preserved across the spectrum, in spite of frequency-dependent correlation in the input signals.

In a second embodiment, the extension towards multiple (more than two) input channels is shown, combined with possible weighting of the input channels mentioned above. The frequency-domain input channels are denoted by $X_n(k)$, for the k-th frequency component of the n-th input channel. The frequency components k of these input channels are grouped in frequency bands i. Subsequently, a correction factor m(i) is computed for subband i as follows:

$$m^2(i)=\frac{\sum_n\sum_{k\in i}|w_n(k)X_n(k)|^2}{n\sum_{k\in i}\left|\sum_n w_n(k)X_n(k)\right|^2}$$

In this equation, $w_n(k)$ denote frequency-dependent weighting factors of the input channels n (which can simply be set to +1 for linear summation). From these correction factors m(i), a correction filter C(k) is generated by interpolation of the correction factors m(i) as described in the first embodiment. Then the mono output channel S(k) is obtained according to:

$$S(k)=C(k)\sum_n w_n(k)X_n(k)$$

It will be seen that using the above equations, the weights of the different channels do not necessarily sum to +1, however, the correction filter automatically corrects for weights that do not sum to +1 and ensures (interpolated) energy preservation in each frequency band.

The invention claimed is:

1. A method of generating a monaural signal comprising a combination of at least two input audio signals, said method comprising the steps of:

dividing said at least two input audio signals into a plurality of sequential segments;

summing, for each of the sequential segments of said audio signals, corresponding frequency components from respective frequency spectrum representations for each audio signal to form a set of summed frequency components for each sequential segment;

calculating, for each of the sequential segments, a correction factor for each of a plurality of frequency bands (i) as function of the energy of the frequency components of the summed frequency components in said band $$\left(\sum_{k\in i}|S(k)|^2\right)$$

and the energy of said frequency components of the input audio signals in said band $$\left(\sum_{k\in i}\{|L(k)|^2+|R(k)|^2\}\right);$$

correcting each summed frequency component as a function of the correction factor (m(i)) for the frequency band of said component; and outputting said corrected summed frequency components as said monaural signal.

2. The method as claimed in claim 1, wherein said method further comprises the steps of:

providing a respective set of sampled signal values for each of a plurality of sequential segments for each input audio signal; and transforming, for each of said plurality of sequential segments, each of said set of sampled signal values into the frequency domain to provide complex frequency spectrum representations of each input audio signal.

3. The method as claimed in claim 2, wherein the step of providing said sets of sampled signal values comprises:

combining, for each input audio signal, overlapping segments into respective time-domain signals representing each input audio signal for a time window.

4. The method as claimed in claim 1, wherein said method further comprises the step of:

converting, for each sequential segment, said corrected frequency spectrum representation of said summed frequency components into the time domain.

5. The method as claimed in claim 4, wherein said method further comprises the step of:

applying overlap-add to successive converted summed signal representations to provide a final summed signal.

6. The method as claimed in claim 1 wherein two input audio signals are summed, and wherein said correction factors (m(i)) are determined according to the function:

$$m^2(i) = \frac{\sum_{k\in i}\{|L(k)|^2 + |R(k)|^2\}}{2\sum_{k\in i}|S(k)|^2} = \frac{\sum_{k\in i}\{|L(k)|^2 + |R(k)|^2\}}{2\sum_{k\in i}|L(k) + R(k)|^2}.$$

7. The method as claimed in claim 1, wherein two or more input audio signals are summed according to the function:

$$S(k) = C(k)\sum_n w_n(k)X_n(k)$$

wherein C(k) is the correction factor for each frequency component, and wherein said correction factors for each frequency band are determined according to the function:

$$m^2(i) = \frac{\sum_n\sum_{k\in i}|w_n(k)X_n(k)|^2}{n\sum_{k\in i}\left|\sum_n w_n(k)X_n(k)\right|^2}$$

wherein wn(k) comprises a frequency-dependent weighting factor for each input audio signal.

8. The method as claimed in claim 7, wherein $w_n(k)=1$ for all input audio signals.

9. The method as claimed in claim 7, wherein $w_n(k)\neq 1$ for at least some of the input audio signals.

10. The method as claimed in claim 7, wherein the correction factor for each frequency component is derived from a linear interpolation of the correction factors for at least one band.

11. The method as claimed in claim 1, wherein said method further comprises the steps of:

determining, for each of said plurality of frequency bands, an indicator of the phase difference between frequency components of said audio signals in a sequential segment; and prior to summing corresponding frequency components, transforming the frequency components of at least one of said audio signals as a function of said indicator for the frequency band of said frequency components.

12. The method as claimed in claim 11, wherein said transforming step comprises operating the following functions on frequency components of left and right input audio signals:

$$L'(k)=e^{jc\alpha(i)}L(k)$$

$$R'(k)=e^{-j(1-c)\alpha(i)}R(k)$$

wherein 0·c·1 determines the distribution of phase alignment between the said input audio signals.

13. The method as claimed in claim 1, wherein said correction factor is a function of a sum of energy of the frequency components of the summed signal in said band and a sum of the energy of said frequency components of the input audio signals in said band.

14. An apparatus for generating a monaural signal from a combination of at least two input audio signals, comprising:

a segmenter for dividing said at least two input audio signals into a plurality of sequential segments;

a summer for summing, for each of the sequential segments of said audio signals, corresponding frequency components from respective frequency spectrum representations for each audio signal to form a set of summed frequency components for each sequential segment;

means for calculating a correction factor for each of a plurality of frequency bands (i) of each of said plurality of sequential segments as function of the energy of the frequency components of the summed frequency components in said band $$\left(\sum_{k\in i}|S(k)|^2\right)$$

and the energy of said frequency components of the input audio signals in said band $$\left(\sum_{k\in i}\{|L(k)|^2 + |R(k)|^2\}\right);$$

and a correction filter for correcting each summed frequency component as a function of the correction factor for the frequency band of said component, said correction filter outputting the monaural signal.

* * * * *